US010435881B1

(12) United States Patent
Ventriglia et al.

(10) Patent No.: US 10,435,881 B1
(45) Date of Patent: Oct. 8, 2019

(54) SYSTEMS AND METHODS FOR FABRICATING CONCRETE OUTDOOR LIVING SUBSTRUCTURES

(71) Applicant: StoneFire Outdoor Living, Inc., Westborough, MA (US)

(72) Inventors: Giuseppe Ventriglia, Westborough, MA (US); Dennis Michael DePierri, Charlton, MA (US)

(73) Assignee: StoneFire Outdoor Living, Inc., Westborough, MA (US)

( * ) Notice: Subject to any disclaimer, the term of this patent is extended or adjusted under 35 U.S.C. 154(b) by 0 days.

(21) Appl. No.: 16/137,121

(22) Filed: Sep. 20, 2018

(51) Int. Cl.

| | |
|---|---|
| ***E04B 1/38*** | (2006.01) |
| ***E04B 1/16*** | (2006.01) |
| ***E04B 2/86*** | (2006.01) |
| ***F24B 1/181*** | (2006.01) |

(52) U.S. Cl.
CPC ..... *E04B 1/16* (2013.01); *E04B 2/86* (2013.01); *F24B 1/181* (2013.01)

(58) Field of Classification Search
CPC ..... E04B 1/16; E04B 2/86; F24B 1/181
USPC ..... 52/698
See application file for complete search history.

(56) References Cited

U.S. PATENT DOCUMENTS 3,874,364 A * 4/1975 Fauser ..... F24B 1/1885 126/518
4,384,566 A 5/1983 Smith
4,422,438 A * 12/1983 Scholz ..... F24B 1/18 126/500
4,478,208 A * 10/1984 Pitha ..... F24B 1/1885 110/336
5,003,739 A * 4/1991 Newsome ..... F24B 1/18 285/43
6,892,505 B1 * 5/2005 Pingitore ..... B28B 23/02 264/32
2011/0131914 A1 * 6/2011 Richardson ..... E04G 23/02 52/514.5
2011/0232203 A1 * 9/2011 Anderson ..... B21D 5/08 52/86
2012/0204857 A1 8/2012 Goodson
2015/0027435 A1 1/2015 Manthei et al.
2016/0169526 A1 6/2016 Paulding

OTHER PUBLICATIONS

"Installation and Operation Instructions Stone Age Fireplace," Stone Age Manufacturing, Inc., Apr. 2013, pp. 1-9.

* cited by examiner

*Primary Examiner* — Basil S Katcheves
(74) *Attorney, Agent, or Firm* — Cesari and McKenna, LLP; Michael R. Reinemann

(57) ABSTRACT

Systems and methods fabricate precast concrete substructures or cores for creating outdoor living structures, such as fireplaces. A mold assembly may include a base section, an outer form section, and an inner form section. The outer and base sections may include pockets for receiving the forks of a fork lift. The outer section may be placed onto the base section, and the inner form section may be suspended within the outer form section. The base section may include three-dimensional (3D) shapes for creating voids in the core to reduce weight. The outer form section may include channels for forming slots in the core, and the base section may include slots for receiving the channels. The channels and slots may be positioned to align the outer form section to the base section as desired.

20 Claims, 9 Drawing Sheets

SYSTEMS AND METHODS FOR FABRICATING CONCRETE OUTDOOR LIVING SUBSTRUCTURES

BACKGROUND

Technical Field

The present disclosure relates to systems and methods for constructing outdoor living structures and, more specifically for fabricating precast concrete substructures for use in constructing outdoor living structures.

Background Information

The term "hardscape" refers to manmade outdoor structures that are incorporated into a landscape, and that are formed from hard materials, such as stone, brick, and blocks (sometimes, referred to as pavers). Examples of hardscapes include fountains, benches, gazebos, fireplaces, fire pits, bars, grills, ovens, etc., generally referred to as outdoor living structures. Typically, a contractor constructs an outdoor living structure on-site, e.g., at the customer's home, by assembling the pavers into the desired structure, for example with mortar. Because the structures would break apart if moved, they are constructed assembled at the final site. The construction of such structures can be time-consuming. Furthermore, in many cases, the structures are built by landscapers or other contractors who often lack experience or skill in stonemasonry. As a result, the creation of outdoor living structures is often expensive, disruptive to the homeowner, and of low to moderate quality.

Thus, a need exists for ways to produce higher quality, less expensive outdoor living structures, and to install those structures in less time.

SUMMARY

Briefly, the present disclosure relates to systems and methods for fabricating precast concrete substructures or cores for use in creating outdoor living structures, such as fireplaces. With the systems and methods, the cores may be formed in a controlled environment, such as in a factory space. The cores may then be transported, for example to a job site for finishing. After the core is positioned at the job site, brick and/or stone may be attached to the outer surface of the cores, e.g., using mortar, to form a finished outdoor living structure.

The systems and methods include a mold assembly that, in some embodiments, may include a base section, an outer form section, and an inner form section. The sections are reusable, and may be assembled to form the mold assembly for casting the cores in a single pour of concrete. Both the outer form section and the base section may include built-in transport elements, such as pockets or slots configured to receive the forks of a fork lift. The transport elements of the outer section may be used to place the outer section onto the base section, and to properly align the outer section to the base section. The inner form section may have outside dimensions that are be slightly smaller than inside dimensions of the outer form section so that the inner form section may be placed, at least partially, inside the outer form section. In addition, the inner form section may include suspension elements that may engage the outer form section to suspend the inner form section within the outer form section and to align it within the outer form section. The built-in transport elements of the base section may be utilized to move the mold assembly, e.g., from a mold assembly area of the factory space to a concrete pouring area.

With the inner and outer form sections and the base section assembled to form the mold assembly, concrete may be poured into the mold assembly, for example in the gap between the inner and outer form sections. The concrete may flow downwardly under gravity toward the base section. The base section may include one or more shapes located in the interior of the base section. The one or more shapes at least partially block the flow of concrete inside the mold assembly, resulting in the formation of one or more internal voids, e.g., open spaces, in the core being fabricated. The internal voids reduce the amount of concrete used to fabricate the core, thereby reducing its weight. The built-in transport elements of the platform section may be utilized to move the filled mold assembly, e.g., from the pouring area to a curing area, where the concrete is allowed to cure under desired moisture and temperature conditions to create the core.

In some embodiments, the inner form section may include reduction means for reducing the size of the inner form section. When the concrete has cured, the reduction means may be activated to shrink the size of the inner form section. The inner form section can then be removed, e.g., pulled, from the outer form section. The outer form section may then be lifted off of the base section, using the transport elements of the outer form section.

The base section also may include a pair of spaced-apart, longitudinal casings located in the its interior. The casings block the flow of concrete, resulting in the formation of slots or pockets in the core. By placing the forks of a fork lift in these slots or pockets, the finished core may be lifted out of the base section, and moved, e.g., to a storage or inventory area of the factory space. The core may also be lifted onto a truck, again using the slots or pockets, for shipment to a job site.

The one-piece construction, e.g., resulting from the single pour of concrete, together with the creation of voids results in a core that is both sturdy and light weight, even for large outdoor living structures. As a result, the cores may be transported, e.g., by truck, from the factory space to the job site and positioned at the desired location without collapsing or breaking apart. Bricks, blocks, or stone shaped to fit the outside surface of the core may be attached to the core to produce a finished outdoor structure of high quality in a fraction of the time required by current methods.

BRIEF DESCRIPTION OF THE DRAWINGS

The description below refers to the accompanying drawings, of which.

DETAILED DESCRIPTION OF ILLUSTRATIVE EMBODIMENTS

Firebox

Figure 1:
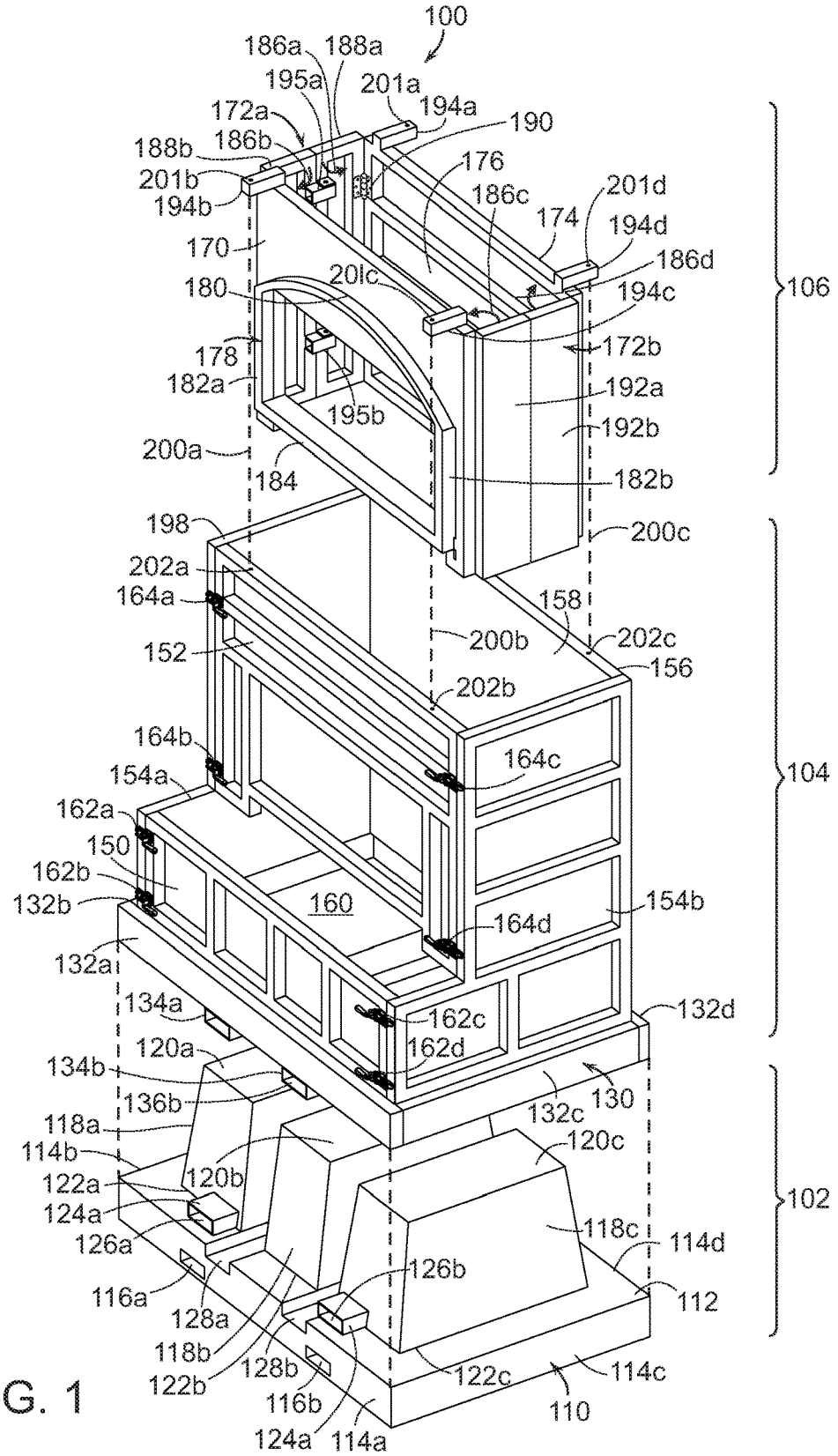
FIG. 1 is an exploded, perspective view of a mold assembly in accordance with one or more embodiments.

FIG. 1 is an exploded, perspective view of a mold assembly 100 for fabricating, e.g., casting from concrete, a substructure or core element of an outdoor living structure, such as a firebox, in accordance with one or more embodiments. The firebox mold assembly 100 may include a base section 102, outer form section 104, and an inner form section 106. The base section 102 may include a generally rectangular platform 110 with a flat upper surface 112. The platform 110 may have a front edge 114*a*, left and right side edges 114*b* and 114*c*, and a back edge 114*d*. Two slots 116*a* and 116*b* may extend through the body of the platform 110 starting at the front edge 114*a*. The two slots 116*a* and 116*b* may extend partially or completely through the platform 110, e.g., to the back edge 114*d*. The two slots 116*a* and 116*b* may be sized and placed relative to each other to receive respective forks of a fork lift, e.g., for moving the base section 102 and/or the entire mold assembly 110 about a factory floor.

One or more interior forms for creating internal voids within the firebox may be supported on, e.g., mounted to, the upper surface 112 of the platform 110 as described herein. In some embodiments, the interior forms may be truncated, rectangular-based pyramids, also referred to as pyramid frustums, as indicated at 118*a*, 118*b*, and 118*c*. The pyramid frustums 118*a*, 118*b*, and 118*c* may have flat top surfaces 120*a*, 120*b*, and 120*c* and bases 122*a*, 122*b*, and 122*c*. The three pyramid frustums 118*a-c* may be lined up in a row on the platform 110, and the bases 122*a-c* may be spaced inward relative to the edges 114*a-d* of the platform 110.

It should be understood that the interior forms may have other three-dimensional (3D) geometric shapes besides and/or in addition to pyramid frustums, such as cubes, cones, cylinders, and/or various combinations thereof. In addition, different numbers of forms instead of three, such as one, two, four, etc. may be used.

Two enclosed, rectangular channels 124*a* and 124*b* may extend through corresponding pyramid frustums, such as the two outer pyramid frustums 118*a* and 118*c* at their bases 122*a* and 122*c*. The channels 124*a* and 124*b* may be open at their ends 126*a* and 126*b*. The open ends 126*a* and 126*b* of the channels 124*a* and 124*b* may not extend all the way to the front edge 114*a* of the platform 110, but may be offset from, e.g., terminate before reaching, the front edge 114*a*. Similarly, the open ends at the back of the channels 124*a* and 124*b* (if present) may terminate before reaching the back edge 114*d*. Two rectangular grooves 128*a* and 128*b* may be formed along the upper surface 112 of the platform 110, for example extending from the front edge 114*a* toward the back edge 114*d*. In some embodiments, the two rectangular grooves 128*a* and 128*b* may extend all the way to the back edge 114*d*.

The outer form section 104 may include a rectangular base 130 have a front edge 132*a*, two side edges 132*b* and 132*c*, and a back edge 132*d*. Two enclosed, rectangular channels 134*a* and 134*b* may mounted underneath the base 130, and may extend from the front edge 132*a* to the back edge 132*d*. The channels 134*a* and 134*b* may be open at their ends 136*a* and 136*b*. The channels 134*a* and 134*b* may be sized and positioned underneath the base 130 so that the channels 134*a* and 134*b* are received in the grooves 128*a* and 128*b* on the upper surface 112 of the platform 110 when the outer form section 104 is placed on the base section 102. Furthermore, the channels 134*a* and 134*b* and the grooves 128*a* and 128*b* are positioned on the base 130 and on the platform 110, respectively, to align the outer form section 104 to the base section 102 when the mold assembly 100 is put together. For example, the channels 134*a* and 134*b* and the grooves 128*a* and 128*b* may be positioned so that the inner surface of the outer section 104 surrounds but is spaced from the pyramid frustums 118*a-c*, and the openings 126*a* and 126*b* of the rectangular channels 124*a* and 124*b* are blocked off.

The outer form section 104 may further include a lower front wall 150, an upper front wall 152, two side walls 154*a* and 154*b*, and a back wall 156, which may all be mounted on the base 130, e.g., opposite the channels 134*a* and 134*b*. The outer form section 104 may define an open, upper interior portion 158 and an open, lower interior portion 160. The front walls 150 and 152 and the back wall 156 may be rectangular shaped. The side walls 154*a* and 154*b* may be L-shaped. Interior surfaces of the walls 150, 152, 154, and 156 may be smooth to create a smooth exterior surface of the core element being cast. The outer form section 104 may be open at its top and bottom.

In some embodiments, the walls 150, 152, 154, and 156 may be separate elements, making it easier to store and move the outer form section 140. Heavy duty clasps may be used to attach the walls 150, 152, 154, and 156 together to create the outer form section 104. For example, clasps 162*a-d* may be used to attach the lower front wall 150 to the side walls 154*a* and 154*b*. Clasps 164*a-d* may be used to attach the upper front wall 152 to the side walls 154*a* and 154*b*. Other clasps (not shown) may be used to attach the back wall 156 to the side walls 154*a* and 154*b*.

The inner form section 106 may include a front wall 170, left and right side walls 172*a* and 172*b*, and a back wall 174. The inner form section 106 may be open at its top and bottom, and may define an open interior 176. A projection 178 may be mounted to the front wall 170. The projection 178 may extend, e.g., jut out, from the front wall 170. The projection 178 may have an arch-shaped top 180, left and right vertical sides 182*a* and 182*b*, and a horizontal bottom 184. The projection forms the opening to the interior of the firebox as described herein.

In an embodiment, the two side walls 172*a* and 172*b* may be formed from side-by-side doors. The doors, which are shown in a closed position or state, may be configured to open inward into the open interior 176 as indicated by arrows 186*a-d*. For example, the left side wall 172*a* may consist of two side-by-side doors 188*a* and 188*b*. The two side-by-side doors 188*a* and 188*b* may be attached to the front and back walls 170 and 174 by hinges of which hinge 190 is shown. The right side wall 172*b* may consist of two side-by-side doors 192*a* and 192*b*, which may also be attached to the front and back walls 170 and 174 by hinges (not shown). One or more locks, such as locks 195*a* and 195*b*, may be provided to secure the doors 188*a* and 188*b* in the closed position. Locks (not shown) may also be provided at the doors 192*a* and 192*b*.

A plurality of, e.g., four, overhanging support elements 194*a-d* may be mounted to a top surface 196 of the inner form section 106.

When assembling the mold assembly 100, the inner form section 106 may be lowered into the interior portion 158 of the outer form section 104. The inner form section 106 may be suspended within the interior portion 158 by virtue of the overhanging support elements 194*a-d*. In particular, the inner form section 106 may be lowered into the outer form section 104 until the overhanging support elements 194*a-d* contact an upper surface 198 of the outer form section 104 as indicated by dashed lines 200*a-c*. The overhanging support elements 194*a-d* suspend the inner form section 106 within the outer form section 104.

The difference in the outer dimensions of the inner form section 106 and the inner dimensions of upper portion of the outer form section 104 creates a space or gap between the outer surface of the inner form section 106 and the inner surface of the upper portion of the outer form section 104. In some embodiments, this gap may be two inches, and may be constant around the entire inner form section 106. In other embodiments, the width of the gap may vary around the inner form 106. As described, concrete may be poured into this gap.

Fasteners may be used to align the inner form section 106 relative to the outer form section 104, and to hold or secure the inner form section 106 relative to the outer form section 104 at the desired gap width. For example, first holes 201*a-d* may be formed through the overhanging support elements 194*a-d*, and matching second holes of which holes 202*a-c* are shown may be formed in the upper surface 198 of the outer form section 104. More specifically, the support elements 194*a-d*, the holes 200*a-d*, and the holes 202*a-c* may be positioned on the inner and outer form sections 106 and 104 to align the outer surfaces of the inner form section 106 the desired spacing from the inner surfaces of the outer form section 104. The inner form section 106 may be lowered down into the outer form section 104, and the matching holes 200*a-d* and 202*a-d* lined up. Registration pins (not shown) or other fasteners may then be inserted in the matching holes 200*a-d* and 202*a-d* to secure, e.g., hold, the inner form section 106 at the desired position within the outer form section 104, thus creating the desired gap or spacing.

The projection 178 may have a depth or thickness matching the gap, such that the projection 178 contacts the inner surface of the outer mold section 104, thereby blocking the flow of cement to an area inside the projection's arch-shaped top 180, sides 182*a* and 182*b*, and bottom 184. As a result, it is not necessary for the front wall 170 of the inner form section 106 to extend into this area inside the projection's arch-shaped top 180, sides 182*a* and 182*b*, and bottom 184, as illustrated in FIG. 1, reducing the weight of the inner mold section 106.

In some embodiments, the walls 150, 152, 154*a*, 154*b*, and 156 of the outer form section 104 may be constructed from flat panels mounted onto frames to provide sufficient strength to the mold assembly 100 during the concrete pouring and curing stages. For example, the flat panels may be plywood or plastic composite sheathing, among other materials. The frames may be formed from metal extrusions welded together. The metal extrusions may be hollow bars, such as hollow square or rectangular aluminum bars to save weight.

The outer form section 104 (with or without the inner form section 106 suspended therein) may be lowered onto the base section 102. For example, the outer form section 104 (with or without the inner form section 106 suspended therein) may be picked up by a fork lift placing its forks in the two enclosed, rectangular channels 134*a* and 134*b*, transported to the base section 102, and lowered onto the base section, such that the channels 134*a* and 134*b* are seated in respective rectangular grooves 128*a* and 128*b* in the upper surface 112 of the platform 110. As described, this aligns the outer form section 104 to the base section 102.

The elements forming the base 130 of the outer form section 104 may have a thickness. For example, the base 130 may be constructed from 2×6 boards (or other suitable material), thereby having a thickness of approximately two inches. The open ends 126*a* and 126*b* of the channels 124*a* and 124*b* in the base section 102 may be spaced this thickness, e.g., two inches, from the front and back edges 114*a* and 114*d*. Accordingly, with the outer form section 104 lowered onto and resting on the base section 102, the open ends 126*a* and 126*b* of the channels 124*a* and 124*b* are blocked off by the front and back elements forming the base 130, thereby preventing concrete from flowing into the open channels 124*a* and 124*b*.

Figure 2:
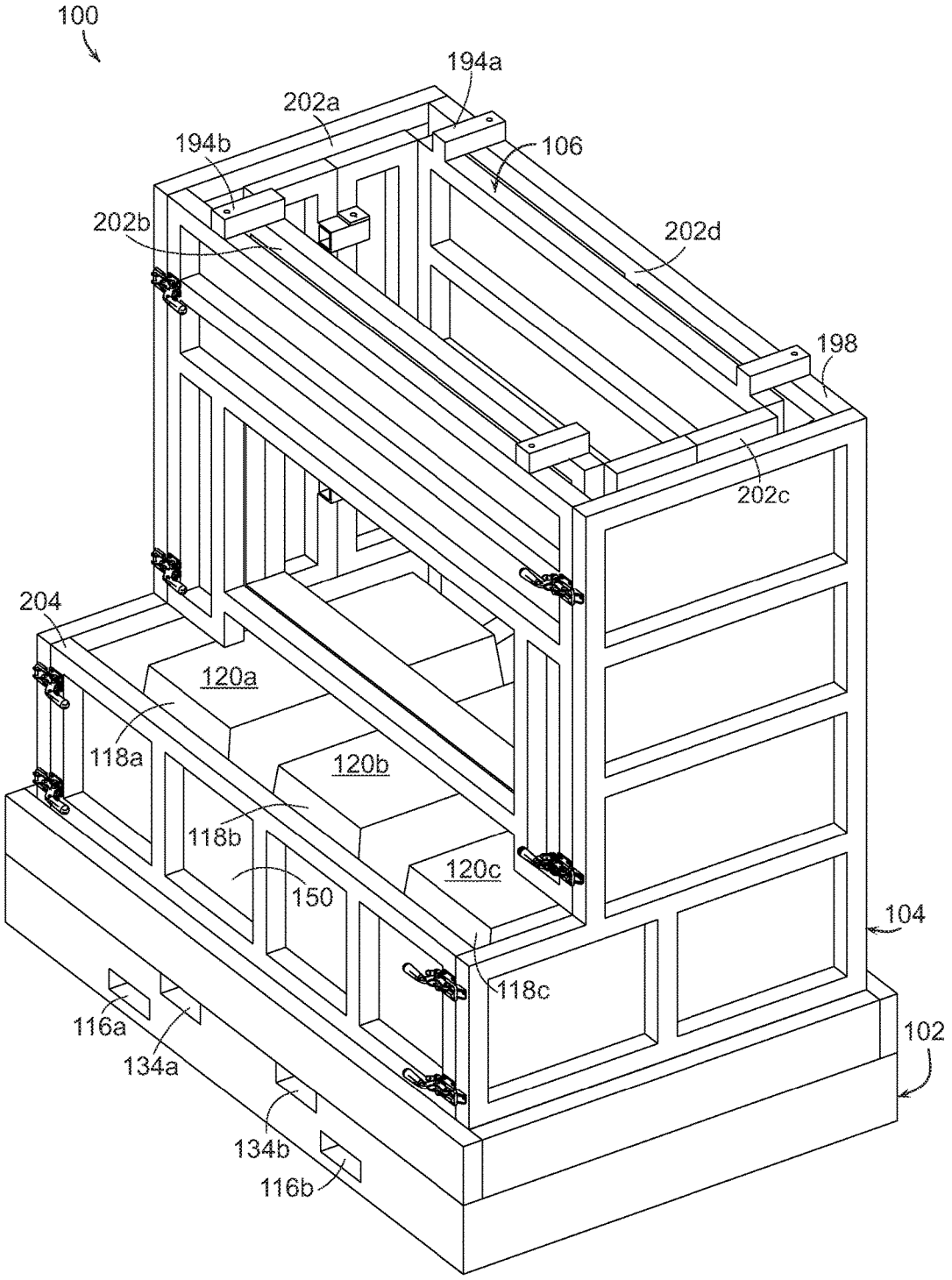
FIG. 2 is a perspective view of the mold assembly of FIG. 1.

FIG. 2 is a perspective view of the mold assembly 100 in an assembled state in accordance with one or more embodiments. As shown, the inner form section 106 may be suspended within the outer form section 104 by the overhanging support elements. Due to the sizing of the outer form section 104 and the inner form section 106, a gap or spacing indicated at 202*a-d* may be defined between outer surfaces of the front, side, and back walls 170, 172*a*, 172*b*, 174 of the inner form section 106 and the inner surfaces of the front, side, and back walls 152, 154*a*, 154*b*, and 156 of the outer form section 104.

In some embodiments, at least a portion of the inner form section 106 may be shrink wrapped in plastic before being lowered into the outer form section 104. The shrink wrap may be wrapped around the angle between the front and back walls 170 and 174 and the adjacent doors 188*a-b* and 192*a-d* that form the side walls 172*a* and 172*b*. The shrink wrap blocks the flow of cement into these angles, thereby allowing the doors 188*a-b* and 192*a-b* to be opened more easily after the concrete cures, thereby facilitating the removal of the inner form section 106 from the cast core element.

In addition, with the outer form section 104 lowered onto the base section 102, the tops 120*a-c* of the pyramid frustums 118*a-c* may be located below an upper edge 204 of the lower front wall 150.

Chimney

Figure 3:
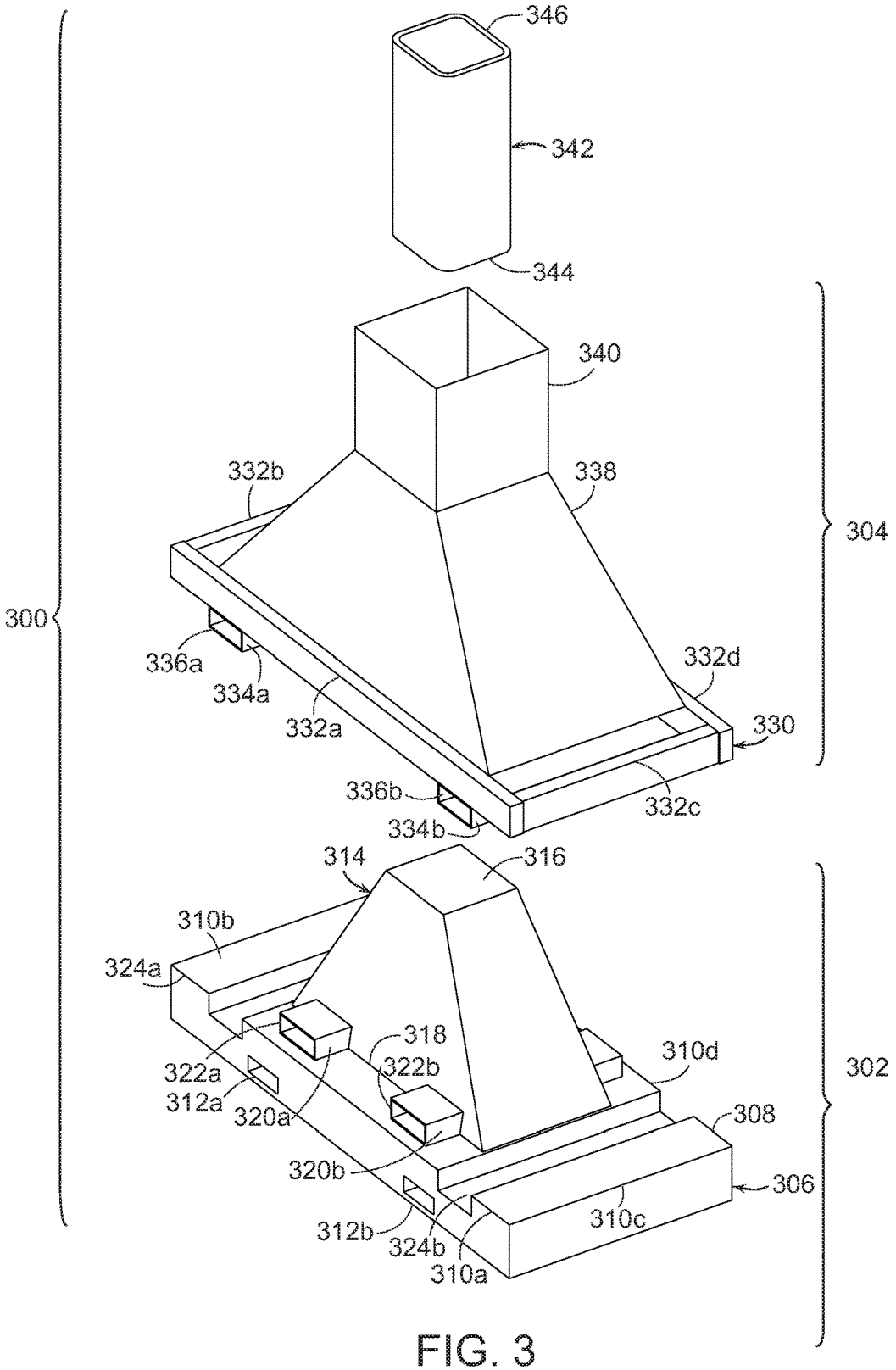
FIG. 3 is an exploded, perspective view of a mold assembly in accordance with one or more embodiments.

FIG. 3 is an exploded, perspective view of a mold assembly 300 for fabricating a substructure or core of an outdoor living structure, such as a chimney, in accordance with one or more embodiments. The chimney mold assembly 300 may include a base section 302 and an outer form section 304. The base section 302 may include a generally rectangular platform 306 with a flat upper surface 308. The platform 306 may have four edges: a front edge 310*a*, left and right side edges 310*b* and 310*c*, and a back edge 310*d*. Two slots 312*a* and 312*b* may extend through the platform 306 starting at the front edge 310*a*. The slots 312*a* and 312*b* may extend partially or completely through the body of the platform 306. The slots 312*a* and 312*b* may be sized and placed relative to each other to receive respective forks of a fork lift, e.g., for moving the base section 302 about a factory floor.

One or more interior forms for creating respective shapes within the chimney may be supported on, e.g., mounted to, the upper surface 308 of the platform 306. For example, a rectangular-based, truncated pyramid form 314 (also referred to as a pyramid frustum) having a flat top surface 316 and a base 318 may be mounted on the platform 306. Two enclosed, rectangular channels 320*a* and 320*b* may extend through the pyramid frustum 314 at its base 318. The channels 320*a* and 320*b* may be open at their ends 322*a* and 322*b*. The open ends 322*a* and 322*b* of the channels 320*a* and 320*b* may not extend all the way to the front edge 310*a* of the platform 306, but may be offset from, e.g., terminate before reaching, the front edge 310*a*. Similarly, the open ends at the back of the channels 320*a* and 320*b* may terminate before reaching the back edge 310*d*. Two rectangular grooves 324*a* and 324*b* may be formed in the upper surface 308 of the platform 306. The outer surfaces of the pyramid frustum 314, the channels 320*a* and 320*b*, and the top surface 308 may be smooth.

The outer form section 304 may include a rectangular support element 330 having four edges: a front edge 332*a*, left and right side edges 332*b* and 332*c*, and a back edge 332*d*. Two enclosed, rectangular channels 334*a* and 334*b* may mounted underneath the support element 330, and may extend from the front edge 332*a* to the back edge 332*c*. The channels 334*a* and 334*b* may be open at their ends 336*a* and 336*b*. The channels 334*a* and 334*b* may be sized and positioned on the support element 330 so that the channels 334*a* and 334*b* are received in the grooves 324*a* and 324*b* on the upper surface 308 of the platform 306 when the outer form section 304 is placed on the base section 302. A hollow, truncated, rectangular pyramid form 338 may be mounted on a top surface of the support element 330.

The channels 334*a* and 334*b* and the grooves 324*a* and 324*b* are positioned on the support element 330 and on the platform 306, respectively, to align the outer form section 304 to the base section 302 when the mold assembly 300 is put together. For example, the channels 334*a* and 334*b* and the grooves 324*a* and 324*b* may be positioned so that the inner surface of the outer section 304 surrounds but is spaced from the pyramid frustum 314, and the openings 322*a* and 322*b* of the rectangular channels 320*a* and 320*b* are blocked off.

A hollow rectangular form 340 may be mounted at the top of the pyramid form 338. The open interior of the rectangular form 340 may lead to the open interior of the pyramid form 338. The pyramid form 338 of the outer form section 304 may have the same shape, e.g., relative dimensions, as the pyramid frustum 314 of the base section 302. However, the pyramid form 338 of the outer form section 304 may be slightly larger than the pyramid frustum 314 of the base section. Accordingly, when the outer form section 304 is placed on the base section 302, a space of several inches, e.g., two to three inches, is created between the outer surface of pyramid frustum 314 and the inner surface of pyramid form 338. The inner surface of the outer form section 304 may be smooth.

A hollow vent element 342 having an open bottom 344 and an open top 346 may be provided for each chimney being cast with the mold assembly 300. The vent element 342 may be sized smaller than the hollow rectangular form 340, so that the vent element 342 may be placed within the hollow rectangular form 340. A space of several inches may be created between the outer surface of the vent element 342 and the inner surface of the rectangular form 340. The bottom 344 of the vent element 342 may rest on the flat top surface 316 of the pyramid frustum 314. In some embodiments, an alignment mechanism, such as brackets or a recess in a top surface of the pyramid frustum 314, may be included to ensure that the vent element 342 is properly positioned within the rectangular form 340.

To cast a chimney using the mold assembly 300, the outer form section 304 may be placed onto the base section 302. More specifically, the channels 334*a* and 334*b* may be seated in the grooves 324*a* and 324*b*, thereby aligning the outer form section 304 to the base section 302.

Figure 4:
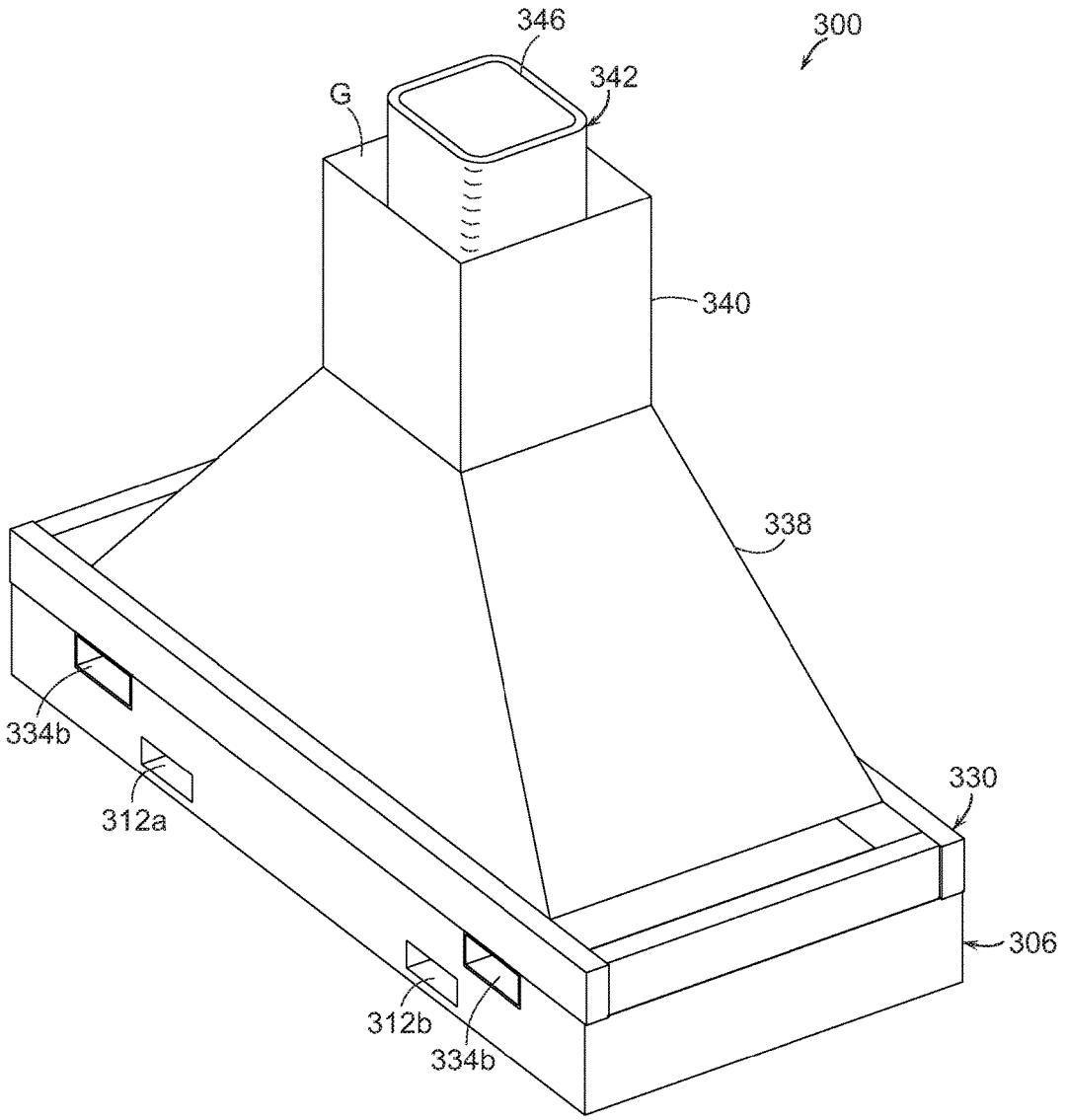
FIG. 4 is a perspective view of the mold assembly of FIG. 3.

FIG. 4 is a perspective view of the mold assembly 300 in an assembled state in accordance with one or more embodiments. For example, the base section 302 may be moved, e.g., by a fork lift using the slots 312*a* and 312*b*, to a concrete casting area of a factory floor. The outer form section 304 may then be placed onto the base section, e.g., by a fork lift using the slots 334*a* and 334*b*. For example, the slots 334*a* and 334*b* of the outer form section 304 may be placed in the grooves 324*a* and 324*b* of the base section 302. When assembled, the pyramid frustum 314 of the base section 302 may be received within the hollow pyramid form 338 of the outer form section 304. The rectangular support element 330 of the outer form section 304 may have a thickness along its front edge 332*a*. The thickness, moreover, may match the offset between the front edge 310*a* of the platform 306 and the ends 322*a* and 322*b* of the channels 320*a* and 320*b*. The support element 330 thus closes the open ends 332*a* and 332*b* of the channels 320*a* and 320*b*. The support element 330 may similarly have a thickness along its back edge 332*c* that matches the offset between the back edge 310*c* of the platform 306 and the opposite ends of the channels 320*a* and 320*b*.

The mold assemblies 100 and 300 may be put together up in a mold assembly area of the factory, and moved to a concrete pouring area. A concrete mix may be made at the concrete pouring area, and poured into the molds 100 and 300.

In some embodiments, the concrete used to create the precast core or substructure elements may include Portland cement, water, sand, and one or more aggregates. Exemplary aggregates may include fiberglass mesh and/or polystyrene foam pellets. Table 1 provides an exemplary concrete mix.

TABLE 1

| Ingredient | Amount |
|---|---|
| Type II Portland Cement | 188 pounds (lbs.) |
| Water | 9-11 gallons |
| Sand | 4.68 cubic feet |
| Fiberglass mesh | 1 lbs. |
| Polystyrene foam pellets | 3.12 cubic feet |

Suitable fiberglass mesh include the Tuf-Strand Maxten synthetic macro-fiber from Euclid Chemical Co. of Cleveland, Ohio The ingredients from Table 1 may be mixed together using a concrete mixer to form a semi-liquid slurry. The slurry may then be poured into the mold assemblies 100 and 300.

With reference to FIG. 2, slurry may be poured into the gap indicated at 202*a-d* between the inner form section 106 and the outer form section 104 along the top surface 198 of the outer form section 104. The slurry may flow down and fill the gap between the inner form section 106 and the outer form section. Slurry may completely surround the inner form section 106, except for the area defined by the projection 178, which as described herein forms the opening of the firebox. Alternatively or additionally, slurry may be poured into the lower interior portion 160 of the outer form section 104 for example in the space between the lower front wall 150 and the upper front wall 152. The slurry may flow around and over the pyramid frustums 118*a-c* of the base section 102, and fill the lower interior portion 160.

A funnel or pouring trough may be used to pour the slurry into the mold assembly 100.

With reference to FIG. 4, slurry may be poured into the gap, G, between the hollow rectangular form 340 and the vent element 342. The slurry may flow down the gap, G, and into the space between the outer surface of the pyramid frustum 314 and the inner surface of the pyramid form 338 of the outer form section 304. The slurry may also completely encircle a lower portion of the vent element 342.

The mold assemblies 100 and 300 may be moved to a curing area of the factory. For example a fork lift may be used to move the mold assemblies 100 and 300. The curing area of the factory may be climate controlled to have a temperature of 55° F. and a humidity of 85% to optimize the curing of the slurry. Because of the use of the interior shapes, even with slurry poured in, the mold assemblies 100 and 300 can still be moved by a fork lift.

The slurry may cure, e.g., solidify and harden, in a process known as hydration. The slurry may be given an optimal time to cure, such as 14 days.

A precast firebox core element may be released from the mold assembly 100. For example, the locks securing the doors 188*a* and 188*b* and the doors 192*a* and 192*b* may be released, and the doors 188*a* and 188*b* and the doors 192*a* and 192*b* rotated inward about their hinges. This transforms the inner form section 106 into two separate pieces, which can then lifted out of the outer form section 104.

Next, the clasps 162*a-d* attaching the lower front wall 150 to the side walls 154*a* and 154*b*, and clasps 164*a-d* attaching the upper front wall 152 to the side walls 154*a* and 154*b* may be released. Other clasps (if present) attaching the back wall 156 to the side walls 154*a* and 154*b* may also be released. The walls 150, 152, 154*a*, 154*b*, and 156 may thus be removed, thereby revealing the precast concrete core firebox.

A fork lift may then be used to lift precast core firebox out of base section 102. Specifically, an operator may slide the forks of a fork lift into slots created in precast core firebox by the enclosed, rectangular channels 124*a* and 124*b* of the base section 102.

A precast core chimney may be released from the mold assembly 300. For example, an operator may place the forks of a fork lift in the enclosed, rectangular channels 334*a* and 334*b*. The operator may then operate the fork lift to lift the outer form section 304 up and away from the base section 302, revealing precast chimney core element resting on the base section 302. The operator may then place the forks of the fork lift in the slots created in the precast core chimney by the enclosed, rectangular channels 320*a* and 320*b* of the base section 302.

The precast core firebox and precast core chimney may then be transported to a finishing area of the factory, e.g., using the forklift.

At the finishing area, the precast core chimney may be mounted onto the precast core firebox to form a precast core fireplace. They may be joined together by mortar or by an adhesive.

Figure 5:
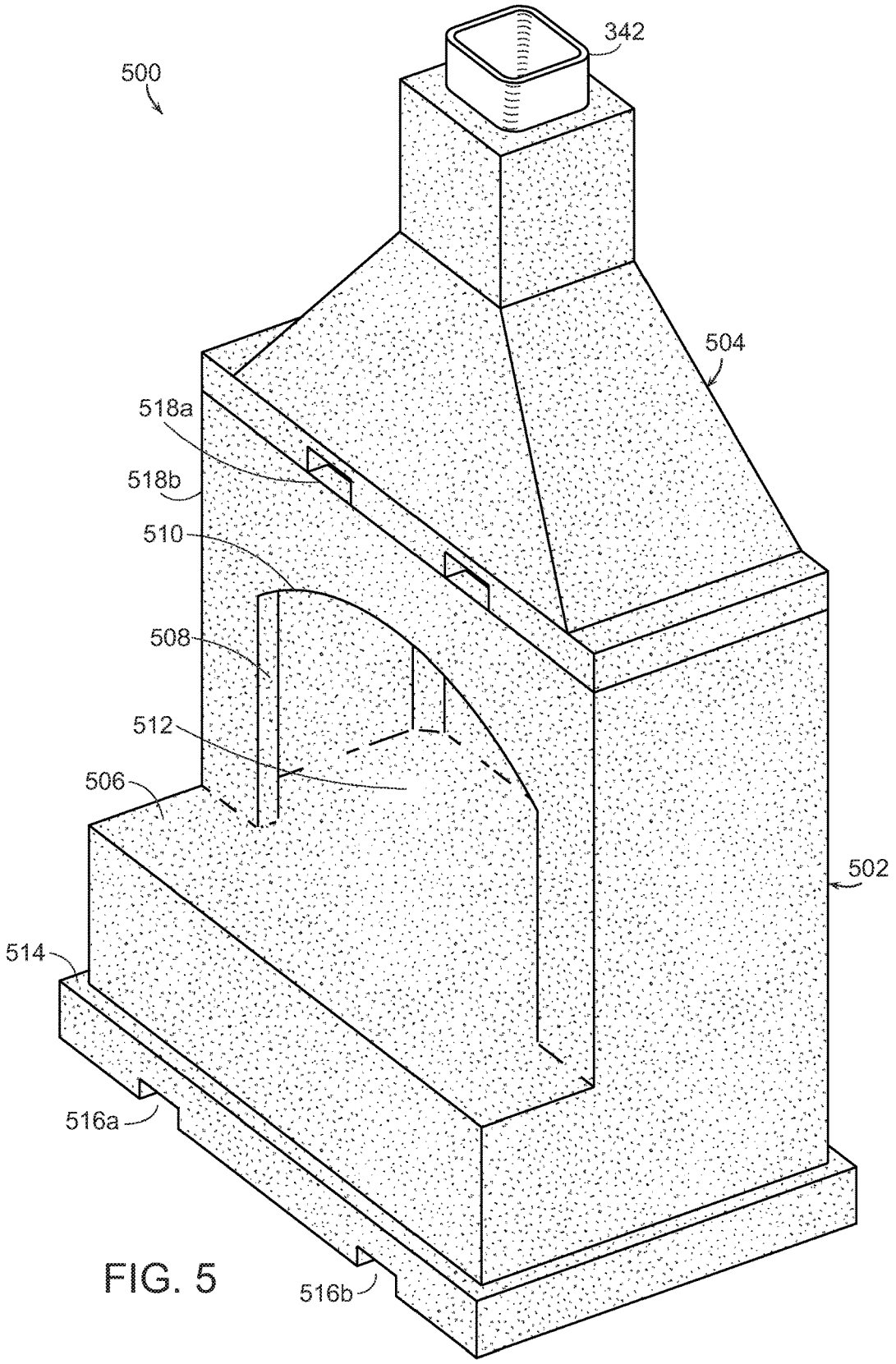
FIG. 5 is a perspective view of a precast concrete substructure in accordance with one or more embodiments.

FIG. 5 is a perspective view of a two-piece precast core fireplace 500 in accordance with one or more embodiments. The precast core fireplace 500 may include a precast core firebox 502 fabricated from the mold assembly 100, and a precast core chimney 504 fabricated from the mold assembly 300. The precast core firebox 502 may include a raised hearth 506 and an opening 508 (created by the projection 178) having a lintel 510 (created by the arch 180). The precast core firebox 502 has an open interior 512. It may also include a lip or rim 514 located below the hearth 506 that may extend all the way around the precast core firebox 502. The precast core firebox 502 also includes slots 516*a* and 516*b* that are formed by the enclosed, rectangular channels 124*a* and 124*b* of the base section 102.

The precast core chimney 504 includes two slots 518*a* and 518*b* formed by the enclosed, rectangular channels 320*a* and 320*b* of the base section 302. The precast core chimney 504 also includes the vent element 342. The precast core chimney 504 has an open interior that connects the open interior 512 of the precast core firebox 502 with the vent element 342.

Figure 6:
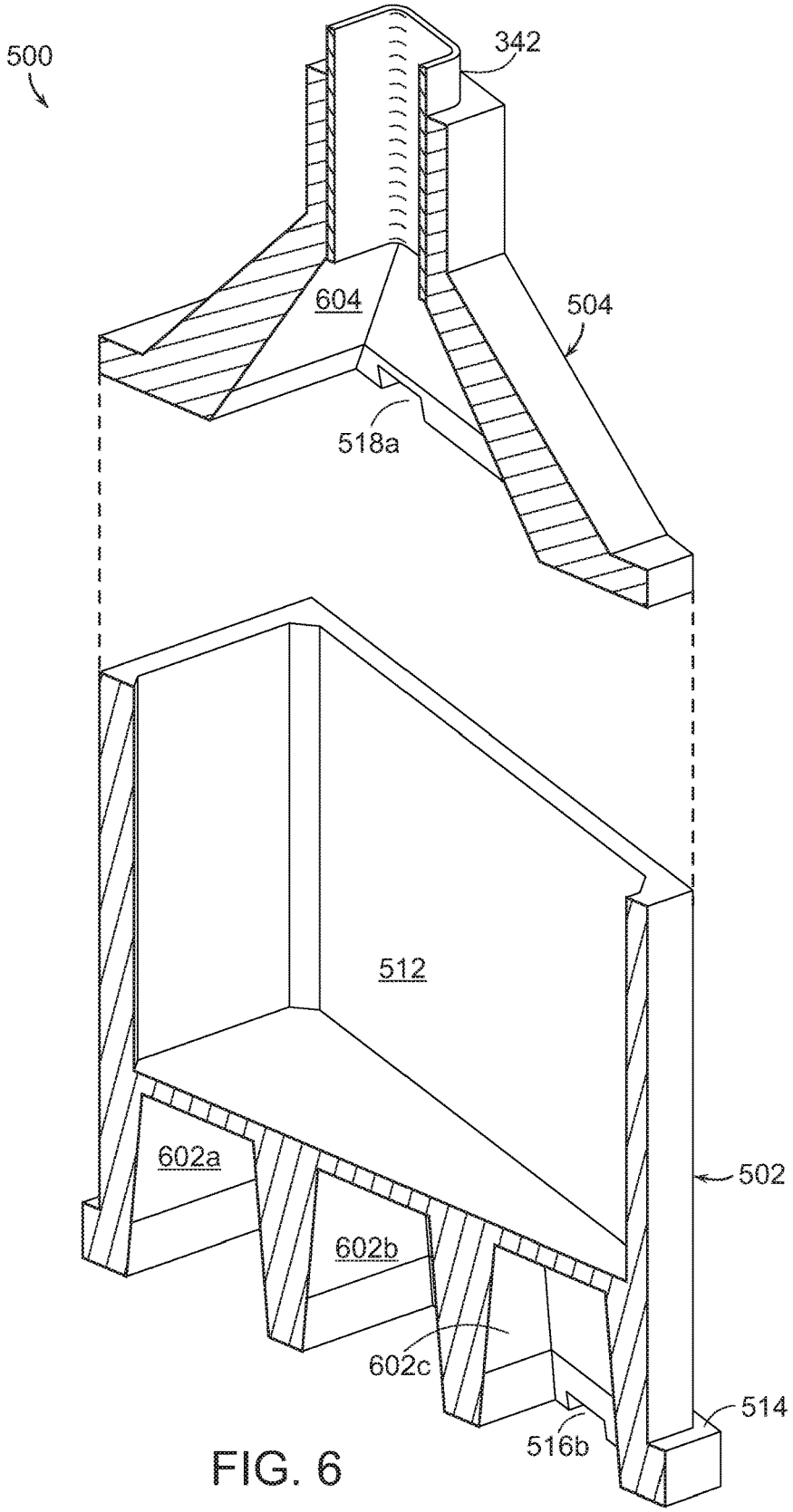
FIG. 6 is an exploded, cut-away view of the precast concrete substructure of FIG. 5 in accordance with one or more embodiments.

FIG. 6 is an exploded, cut-away view of the two-piece precast core fireplace 500 in accordance with one or more embodiments. The precast core firebox 502 is cut-away to reveal voids 602*a-c* in the hearth 506 that are formed by the pyramid frustums 118*a-c* mounted on the platform 110. The precast core chimney 504 is cut-away to reveal an open interior 604 formed by the pyramid frustum 314 mounted on the platform 306. The open interior 604, moreover, connects to the open interior 512 of the precast core firebox 502 and to the vent element 342.

The interior 512 of the firebox 502 may be lined with firebrick or clay bricks. The precast core fireplace 500 may be moved to a storage or inventory area of the factory space. The job site may be prepared. For example, a concrete slap may be poured for supporting the precast core fireplace 500. When the site is ready (or simultaneously with the preparing of the site), the precast core fireplace 500 may be transported to the job site. For example, the precast core fireplace 500 may be moved from the storage or inventory area of the factory, and lifted onto a truck, again using the slots or pockets.

The precast core fireplace 500 may be delivered to the job site and set onto the prepared site, e.g., onto the concrete slab. Stone or brick veneer elements may be attached to the outside of the precast core fireplace 500. The lowest row of stone or brick veneer elements may rest on the lip or rim 514.

Figure 7:
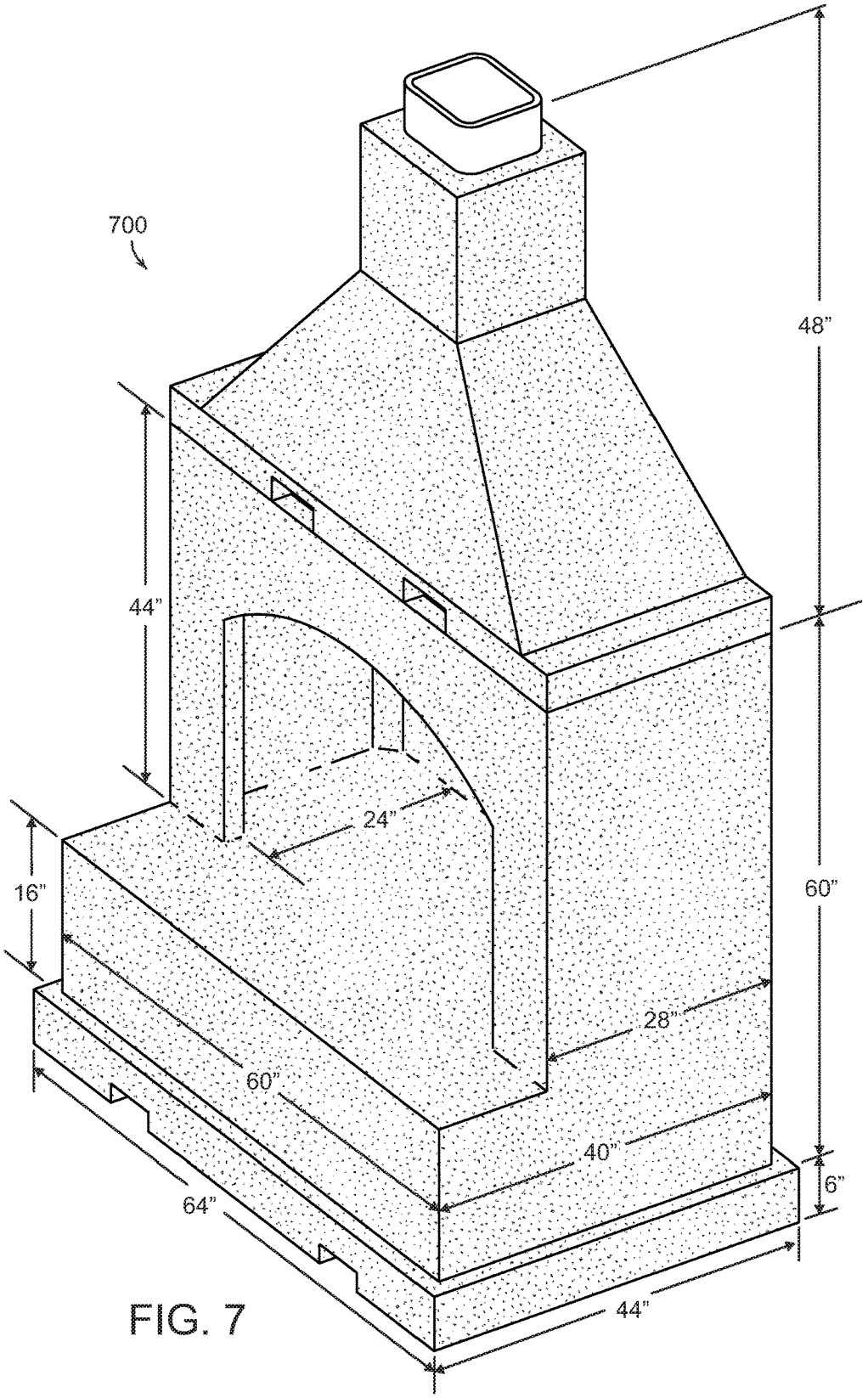
FIG. 7 is a perspective view of a large precast fireplace core in accordance with one or more embodiments.

FIG. 7 is a perspective view of a large two-piece precast core fireplace 700 illustrating its dimensions in accordance with one or more embodiments.

Figure 8:
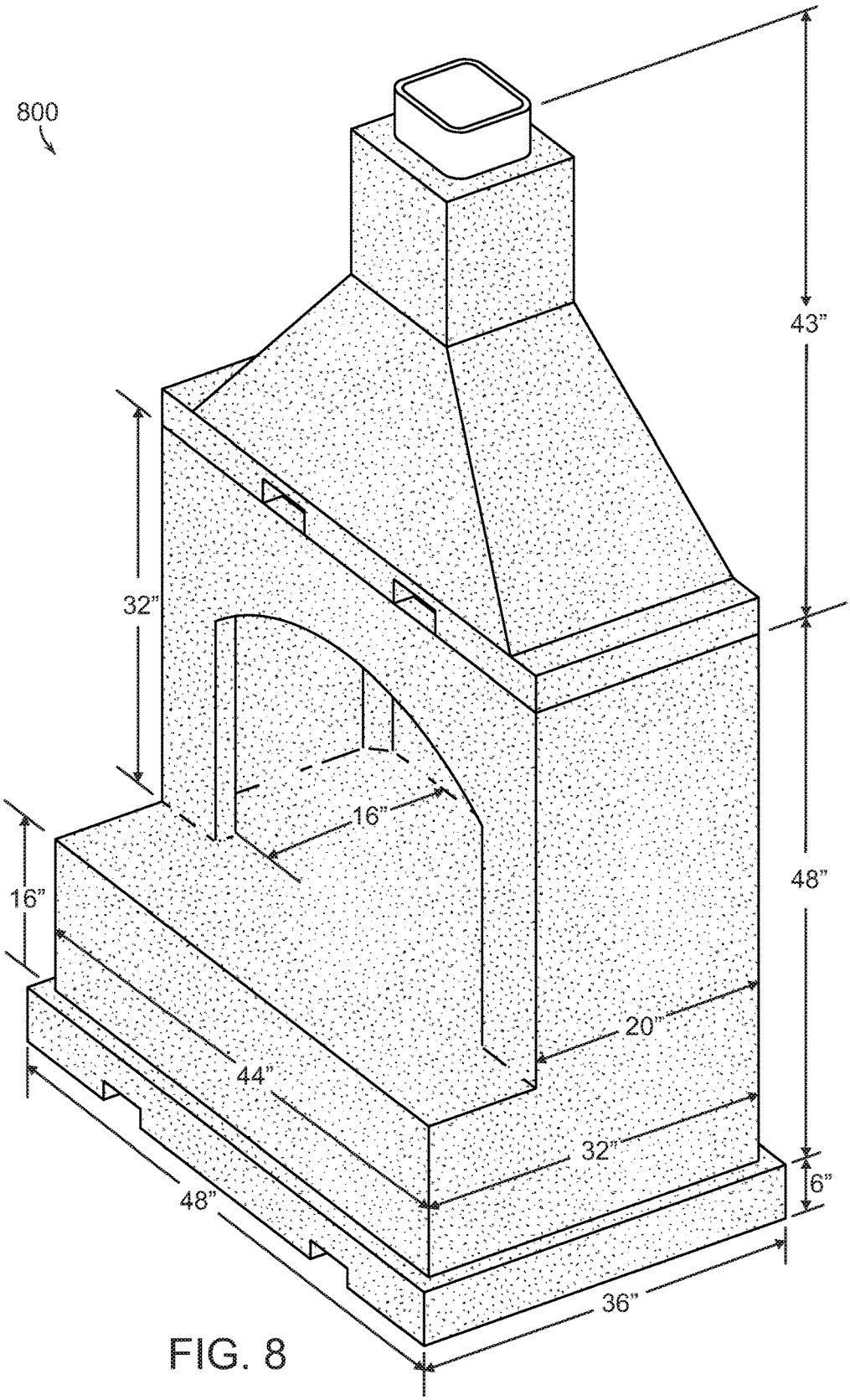
FIG. 8 is a perspective view of a small precast fireplace core in accordance with one or more embodiments.

FIG. 8 is a perspective view of a small two-piece precast core fireplace 800 illustrating its dimensions in accordance with one or more embodiments.

Notwithstanding its size, the precast core fireplace 500 is still light enough to be moved using a forklift. For example, a conventionally produced large outdoor fireplace may weigh approximately 6656 lbs. whereas the large precast core fireplace 700 fabricated according to the present disclosure may weigh 5120 lbs., which is a 30% weight savings. Furthermore, because it is formed from just two pieces, the precast core fireplace 500 is sturdy enough to be loaded onto flatbed trailer, and transported to customer site for installation.

Figure 9:
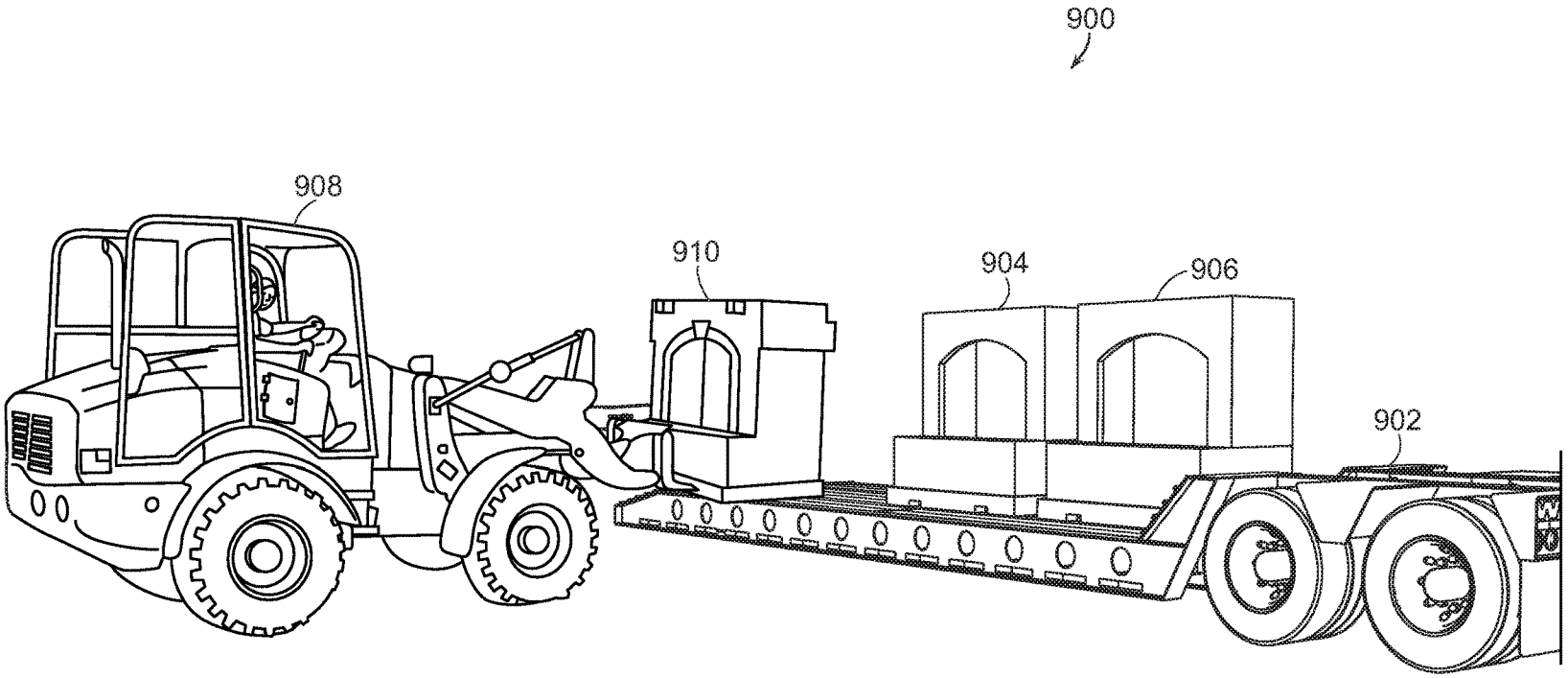
FIG. 9 is a partial view of a loading environment in accordance with one or more embodiments.

FIG. 9 is a partial perspective view of a loading environment 900 in accordance with one or more embodiments. The environment 900 may include a flatbed trailer 902. Already loaded onto the flatbed trailer 902 are two precast core fireplaces 904 and 906. The environment 900 further includes a forklift 908 being used to load another precast core fireplace 910 onto the flatbed trailer 902. The precast core fireplaces 904, 906, and 910 may be secure to the flatbed trailer 902, e.g., using straps, chains, or other means, and the flatbed trailer 902 may be hauled to one or more jobsites. At the jobsites, the precast core fireplaces 904, 906, and 910 may be removed from the flatbed trailer 902, e.g., using a forklift, and placed at the prepared site. Stone or brick veneer elements may be attached to the outside of the precast core fireplaces 904, 906, and 910, thereby producing finished outdoor fireplaces.

It should be understood that those skilled in the art may make modifications or changes without departing from the scope or intent of the invention.

The foregoing description has been directed to specific embodiments of the present disclosure. It will be apparent, however, that other variations and modifications may be made to the described embodiments, with the attainment of some or all of their advantages. Therefore, it is the object of the appended claims to cover all such variations and modifications as come within the true spirit and scope of the invention.

What is claimed is:

1. A mold assembly for casting a concrete core of an outdoor living structure, the mold assembly comprising:

a base section, the base section including a platform having a top surface, two slots extending into the platform and configured to receive respective forks of a forklift, one or more enclosed, three-dimensional (3D) shapes mounted on the top surface of the platform, first channels having openings, and grooves formed along the top surface of the platform;

an outer form section, the outer form section including at least four first walls defining a first open interior, and second channels having openings, the second channels disposed below the at least four first walls and configured to receive the respective forks of the forklift; and an inner form section, the inner form section including four second walls defining a second open interior, wherein the second channels are configured to be seated within the grooves, the grooves are located on the top surface of the platform and the second channels are located relative to the at least four first walls so that, with the second channels seated within the grooves, the outer form section is aligned relative to the base section such that (1) the at least four first walls encompass the one or more enclosed, 3D shapes and (2) the openings of the first channels are blocked, the inner form section is sized relative the outer form section to fit within the outer form section, and to define a gap between the inner form section and the outer form section, and the first open interior is in fluid communication with the gap between the inner form section and the outer form section.

2. The mold assembly of claim 1 wherein the four second walls of the inner form section include a front wall, two pairs of doors forming two side walls, and a back wall, the mold assembly further comprising:

hinges joining the two pairs of doors to the front wall and the back wall of the inner form section, wherein the hinges are arranged such that the two pairs of doors open into the second open interior.

3. The mold assembly of claim 2 wherein the inner form section further includes locks configured to secure the two pairs of doors in a closed position, wherein the two pairs of doors when in the closed position form the two side walls.

4. The mold assembly of claim 2 wherein a projection extends from the front wall of the inner form section, the projection including an arch-shaped top edge having two opposite ends and two vertical side edges joining the two opposite ends of the arch-shaped top edge, wherein the projection fully extends within the gap.

5. The mold assembly of claim 1 wherein the at least four first walls of the outer form section define an upper surface and the inner form section further includes overhanging support elements configured to engage the upper surface to suspend the inner form section within the outer form section.

6. The mold assembly of claim 5 wherein first holes are formed in the at least four walls of the outer form section at the upper surface and second holes are formed through the overhanging support elements in alignment with the first holes in the at least four walls.

7. The mold assembly of claim 1 wherein the at least four first walls of the outer form section are releasably attached to each other.

8. A mold assembly for casting a concrete core of an outdoor living structure, the mold assembly comprising:

a base section, the base section including a platform having a top surface, two slots extending into the platform and configured to receive respective forks of a forklift, an enclosed three-dimensional (3D) shape mounted on the top surface of the platform, first channels extending into the enclosed, 3D shape, the first channels having openings, and grooves formed along the top surface of the platform; and an outer form section, the outer form section including a support element having a top surface, a hollow 3D shape mounted on the top surface of the support element, the 3D shape defining an open interior, and second channels having openings, the second channels mounted to the support element opposite the hollow 3D shape, wherein the second channels of the outer form section are configured to be seated within the grooves, the grooves are located on the top surface of the platform and the second channels are located relative to the hollow 3D shape so that, with the second channels seated within the grooves, (1) the enclosed 3D shape is received within the open interior defined by the hollow 3D shape of the outer form section and (2) the openings of the first channels are blocked.

9. The mold assembly of claim 8 wherein the enclosed 3D shape is a first rectangular-based, truncated pyramid having a first size.

10. The mold assembly of claim 9 wherein the hollow 3D shape is a second rectangular-based, truncated pyramid have a second size, wherein the second size is larger than the first size.

11. The mold assembly of claim 10 wherein the hollow 3D shape further includes an open rectangular upper element.

12. The mold assembly of claim 11 wherein the enclosed 3D shape has a flat top surface, the mold assembly further comprising a hollow vent element having an open bottom and an open top, wherein the hollow vent element is supported on the flat top surface and is positioned within the open rectangular upper element.

13. The mold assembly of claim 12 wherein the hollow vent element is positioned within the open rectangular upper element to define a gap there between, wherein the gap is in fluid communication with the open interior of the outer form section.

14. A method for casting a concrete core of an outdoor living structure, the method comprising:

providing a mold assembly that includes:

a base section, the base section including a platform having a top surface, two slots extending into the platform and configured to receive respective forks of a forklift, one or more enclosed, three-dimensional (3D) shapes mounted on the top surface of the platform, first channels having openings, and grooves formed along the top surface of the platform;

an outer form section, the outer form section including at least four first walls defining a first open interior, and second channels having openings, the second channels disposed below the at least four first walls and configured to receive the respective forks of the forklift; and an inner form section, the inner form section including four second walls defining a second open interior, wherein the second channels are configured to be seated within the grooves, the grooves are located on the top surface of the platform and the second channels are located relative to the at least four first walls so that, with the second channels seated within the grooves, the outer form section is aligned relative to the base section such that (1) the at least four first walls encompass the one or more enclosed, 3D shapes and (2) the openings of the first channels are blocked, the inner form section is sized relative the outer form section to fit within the outer form section, and to define a gap between the inner form section and the outer form section, and the first open interior is in fluid communication with the gap between the inner form section and the outer form section; and pouring a concrete mix into the mold assembly.

15. The method of claim 14 further comprising:

releasing the concrete core from the mold assembly.

16. The method of claim 15 wherein the concrete mix includes Portland cement, water, sand, fiberglass mesh, and polystyrene foam pellets.

17. The method of claim 14 wherein the concrete mix is poured into the gap between the inner form section and the outer form section.

18. A method for casting a concrete core of an outdoor living structure, the method comprising:

providing a mold assembly that includes:

a base section, the base section including a platform having a top surface, two slots extending into the platform and configured to receive respective forks of a forklift, an enclosed three-dimensional (3D) shape mounted on the top surface of the platform, first channels extending into the enclosed, 3D shape, the first channels having openings, and grooves formed along the top surface of the platform; and an outer form section, the outer form section including a support element having a top surface, is a hollow 3D shape mounted on the top surface of the support element, the 3D shape defining an open interior, and second channels having openings, the second channels mounted to the support element opposite the hollow 3D shape, wherein the second channels of the outer form section are configured to be seated within the grooves, the grooves are located on the top surface of the platform and the second channels are located relative to the hollow 3D shape so that, with the second channels seated within the grooves, (1) the enclosed 3D shape is received within the open interior defined by the hollow 3D shape of the outer form section and (2) the openings of the first channels are blocked; and pouring a concrete mix into the mold assembly.

19. The method of claim 18 further comprising:

releasing the concrete core from the mold assembly.

20. The method of claim 19 wherein the concrete mix includes Portland cement, water, sand, fiberglass mesh, and polystyrene foam pellets.

* * * * *